US011619430B2

(12) United States Patent
Martin et al.

(10) Patent No.: US 11,619,430 B2
(45) Date of Patent: Apr. 4, 2023

(54) COOLING SYSTEM WITH VERTICAL ALIGNMENT

(71) Applicant: Heatcraft Refrigeration Products LLC, Stone Mountain, GA (US)

(72) Inventors: Nicole Z. Martin, Marietta, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

(21) Appl. No.: 17/650,100

(22) Filed: Feb. 7, 2022

(65) Prior Publication Data

US 2022/0154986 A1 May 19, 2022

Related U.S. Application Data

(63) Continuation of application No. 16/782,545, filed on Feb. 5, 2020, now Pat. No. 11,287,168.

(51) Int. Cl.

| | |
|---|---|
| ***F25B 41/40*** | (2021.01) |
| ***F25B 41/20*** | (2021.01) |
| ***F25B 1/00*** | (2006.01) |
| ***F25B 49/02*** | (2006.01) |

(52) U.S. Cl.

CPC ..... *F25B 41/40* (2021.01); *F25B 1/00* (2013.01); *F25B 41/20* (2021.01); *F25B 49/02* (2013.01); *F25B 2600/2515* (2013.01); *F25B 2700/1931* (2013.01)

(58) Field of Classification Search

CPC ..... F25B 1/00; F25B 1/10; F25B 2400/13; F25B 2400/23; F25B 2600/2515; F25B 2600/2519; F25B 2700/03; F25B 2700/1931; F25B 31/004; F25B 41/20; F25B 41/40; F25B 41/42; F25B 49/02; F25B 5/02; F25B 9/008

See application file for complete search history.

(56) References Cited

U.S. PATENT DOCUMENTS

| | | | | |
|---|---|---|---|---|
| 4,625,523 | A * | 12/1986 | Toub | F25B 31/004 62/193 |
| 6,058,727 | A | 5/2000 | Fraser, Jr. et al. | |
| 11,149,997 | B2 | 10/2021 | Zha | |
| 2009/0093916 | A1* | 4/2009 | Parsonnet | F24F 5/0017 700/286 |

(Continued)

FOREIGN PATENT DOCUMENTS

| | | | |
|---|---|---|---|
| EP | 3584513 | A1 | 12/2019 |
| WO | 2008101688 | A1 | 8/2008 |

OTHER PUBLICATIONS

European Patent Office, Extended European Search Report, Application No. 21154923.3, dated Jun. 4, 2021, 5 pages.

*Primary Examiner* — Henry T Crenshaw

(74) *Attorney, Agent, or Firm* — Baker Botts L.L.P.

(57) ABSTRACT

A cooling system uses P-traps to address the oil return issues that result from a vertical separation between a compressor and a heat exchanger. Generally, the vertical piping that carries the refrigerant from the compressor to the heat exchanger includes P-traps installed at various heights to capture oil in the refrigerant and to prevent that oil from flowing back to the compressor. T-connections are coupled to the P-traps to allow the oil to drain out of the P-traps. The oil may then be collected and returned to the compressor.

20 Claims, 6 Drawing Sheets

(56) References Cited

U.S. PATENT DOCUMENTS

| | | | | |
|---|---|---|---|---|
| 2018/0187928 | A1 | 7/2018 | Zha | |
| 2018/0195773 | A1* | 7/2018 | Saunders | F25B 41/20 |
| 2018/0274835 | A1* | 9/2018 | Goel | F25B 31/00 |
| 2021/0239373 | A1 | 8/2021 | Martin et al. | |

* cited by examiner

COOLING SYSTEM WITH VERTICAL ALIGNMENT

CROSS-REFERENCE TO RELATED APPLICATIONS

This application is a continuation of U.S. patent application Ser. No. 16/782,545 filed Feb. 5, 2020, by Nicole Z. Martin et al., and entitled "COOLING SYSTEM WITH VERTICAL ALIGNMENT," which is incorporated herein by reference.

TECHNICAL FIELD

This disclosure relates generally to a cooling system.

BACKGROUND

Cooling systems may cycle a refrigerant (e.g., carbon dioxide refrigerant) to cool various spaces.

SUMMARY

Cooling systems may cycle a refrigerant (e.g., carbon dioxide refrigerant) to cool various spaces. These systems typically include a compressor to compress refrigerant and a high side heat exchanger that removes heat from the compressed refrigerant. When the compressor compresses the refrigerant, oil that coats certain components of the compressor may mix with and be discharged with the refrigerant.

When these systems are installed in tall buildings (e.g., high-rises), the high side heat exchanger may be installed on the roof of the building while the compressor is installed on a lower floor of the building. As a result, a significant vertical separation may exist between the compressor and the high side heat exchanger. If refrigerant from the compressor were directed to the high side heat exchanger, the oil that mixed with the refrigerant discharged by the compressor may not be able to overcome the vertical separation and, as a result, the oil may flow backwards to the compressor. To avoid this oil return issue, conventional systems use a separate water cooling system that cycles water that absorbs heat from the refrigerant discharged by the compressor. The water is then pumped to the high side heat exchanger on the roof so that the absorbed heat can be removed. The cooled refrigerant is cycled back to the rest of the cooling system, bypassing the high side heat exchanger. The water cooling system, however, increases the overall energy consumption, size, and cost of the cooling system.

This disclosure contemplates an unconventional cooling system that uses P-traps to address the oil return issues that result from a vertical separation between the compressor and the high side heat exchanger. Generally, the vertical piping that carries the refrigerant from the compressor to the high side heat exchanger includes P-traps installed at various heights to capture oil in the refrigerant and to prevent that oil from flowing back to the compressor. T-connections are coupled to the P-traps to allow the oil to drain out of the P-traps. The oil may then be collected and returned to the compressor. Certain embodiments of the cooling system are described below.

According to an embodiment, a system includes a high side heat exchanger, a flash tank, a first low side heat exchanger, a second low side heat exchanger, a first compressor, a second compressor, piping, a receiver, a first valve, and a second valve. The high side heat exchanger removes heat from a refrigerant. The flash tank stores the refrigerant. The first low side heat exchanger uses the refrigerant to cool a space proximate the first low side heat exchanger. The second low side heat exchanger uses the refrigerant to cool a space proximate the second low side heat exchanger. The first compressor compresses refrigerant from the first low side heat exchanger. The second compressor compresses refrigerant from the second low side heat exchanger and the first compressor. The high side heat exchanger is positioned vertically above the second compressor. The piping directs refrigerant from the second compressor to the high side heat exchanger. The piping includes a first P-trap positioned vertically above the second compressor and vertically below the high side heat exchanger and a second P-trap positioned vertically above the first P-trap and vertically below the high side heat exchanger. The first valve controls a flow of refrigerant and oil from the first P-trap to the receiver. The second valve controls a flow of refrigerant and oil from the second P-trap to the receiver.

According to another embodiment, a method includes removing, by a high side heat exchanger, heat from a refrigerant and storing, by a flash tank, the refrigerant. The method also includes using, by a first low side heat exchanger, the refrigerant to cool a space proximate the first low side heat exchanger and using, by a second low side heat exchanger, the refrigerant to cool a space proximate the second low side heat exchanger. The method further includes compressing, by a first compressor, refrigerant from the first low side heat exchanger and compressing, by a second compressor, refrigerant from the second low side heat exchanger and the first compressor. The high side heat exchanger is positioned vertically above the second compressor. The method also includes directing, by piping, refrigerant from the second compressor to the high side heat exchanger. The piping includes a first P-trap positioned vertically above the second compressor and vertically below the high side heat exchanger and a second P-trap positioned vertically above the first P-trap and vertically below the high side heat exchanger. The method further includes controlling, by a first valve, a flow of refrigerant and oil from the first P-trap to a receiver and controlling, by a second valve, a flow of refrigerant and oil from the second P-trap to the receiver.

According to yet another embodiment, a system includes a low side heat exchanger, a compressor, a high side heat exchanger, piping, a receiver, a first valve, and a second valve. The low side heat exchanger uses a refrigerant to cool a space proximate the low side heat exchanger. The compressor compresses refrigerant from the low side heat exchanger. The high side heat exchanger removes heat from the refrigerant from the compressor. The high side heat exchanger is positioned vertically above the compressor. The piping directs refrigerant from the compressor to the high side heat exchanger. The piping includes a first P-trap positioned vertically above the compressor and vertically below the high side heat exchanger and a second P-trap positioned vertically above the first P-trap and vertically below the high side heat exchanger. The first valve controls a flow of refrigerant and oil from the first P-trap to the receiver. The second valve controls a flow of refrigerant and oil from the second P-trap to the receiver.

Certain embodiments provide one or more technical advantages. For example, an embodiment uses P-traps to prevent oil from flowing back to a compressor when there is a vertical separation between the compressor and a high side heat exchanger. As another example, an embodiment reduces energy consumption, size, and cost relative to a cooling system that uses a separate water cooling system to overcome a vertical separation between a compressor and a high side heat exchanger. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIG. 1A through 3 of the drawings, like numerals being used for like and corresponding parts of the various drawings.

Cooling systems may cycle a refrigerant (e.g., carbon dioxide refrigerant) to cool various spaces. These systems typically include a compressor to compress refrigerant and a high side heat exchanger that removes heat from the compressed refrigerant. When the compressor compresses the refrigerant, oil that coats certain components of the compressor may mix with and be discharged with the refrigerant.

When these systems are installed in tall buildings (e.g., high-rises), the high side heat exchanger may be installed on the roof of the building while the compressor is installed on a lower floor of the building. As a result, a significant vertical separation may exist between the compressor and the high side heat exchanger. If refrigerant from the compressor were directed to the high side heat exchanger, the oil that mixed with the refrigerant discharged by the compressor may not be able to overcome the vertical separation and, as a result, the oil may flow backwards to the compressor. To avoid this oil return issue, conventional systems use a separate water cooling system that cycles water that absorbs heat from the refrigerant discharged by the compressor. The water is then pumped to the high side heat exchanger on the roof so that the absorbed heat can be removed. The cooled refrigerant is cycled back to the rest of the cooling system, bypassing the high side heat exchanger. The water cooling system, however, increases the overall energy consumption, size, and cost of the cooling system.

Figure 1A:
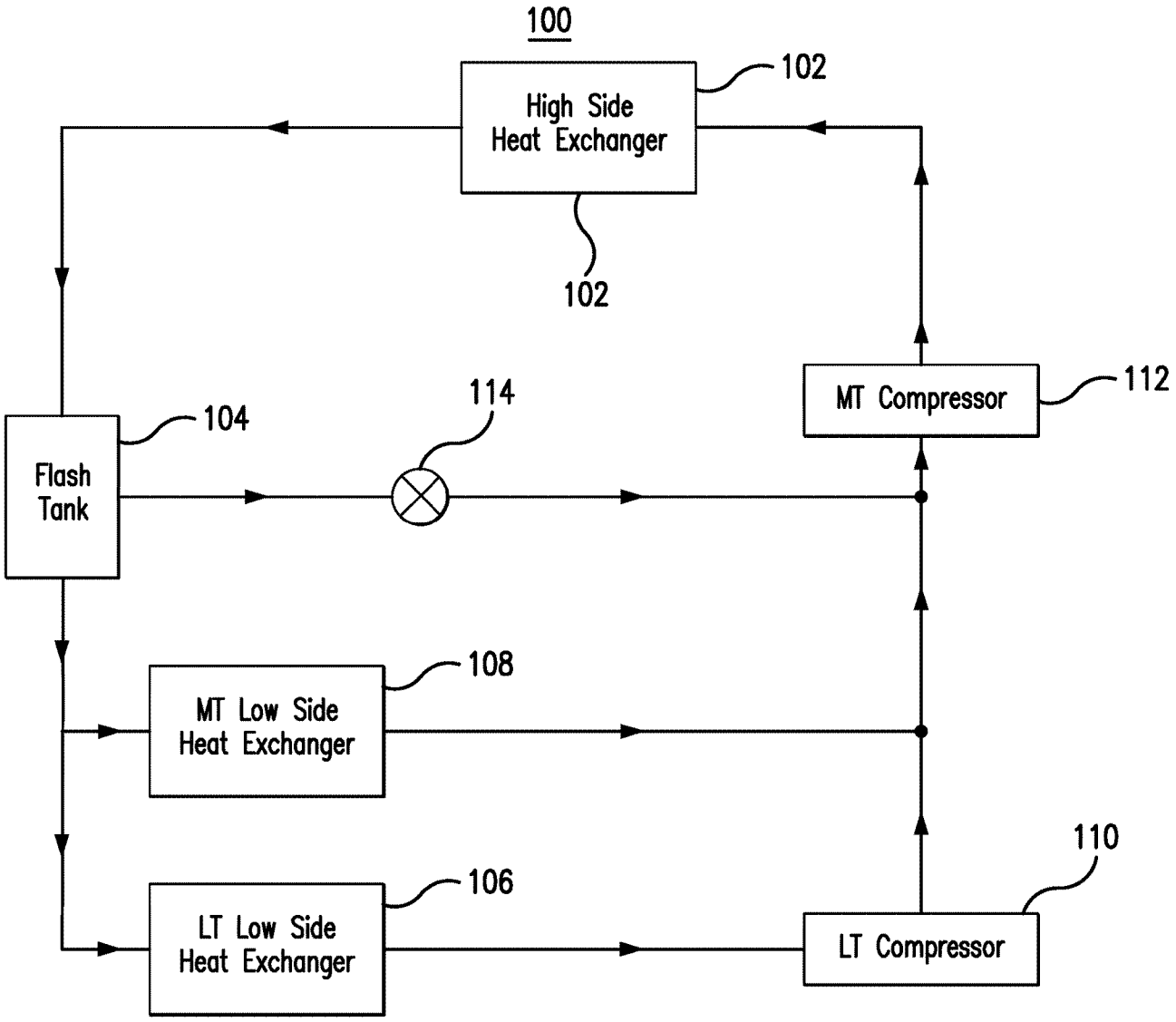
FIGS. 1A-1B illustrate an example cooling system.
Figure 1B:
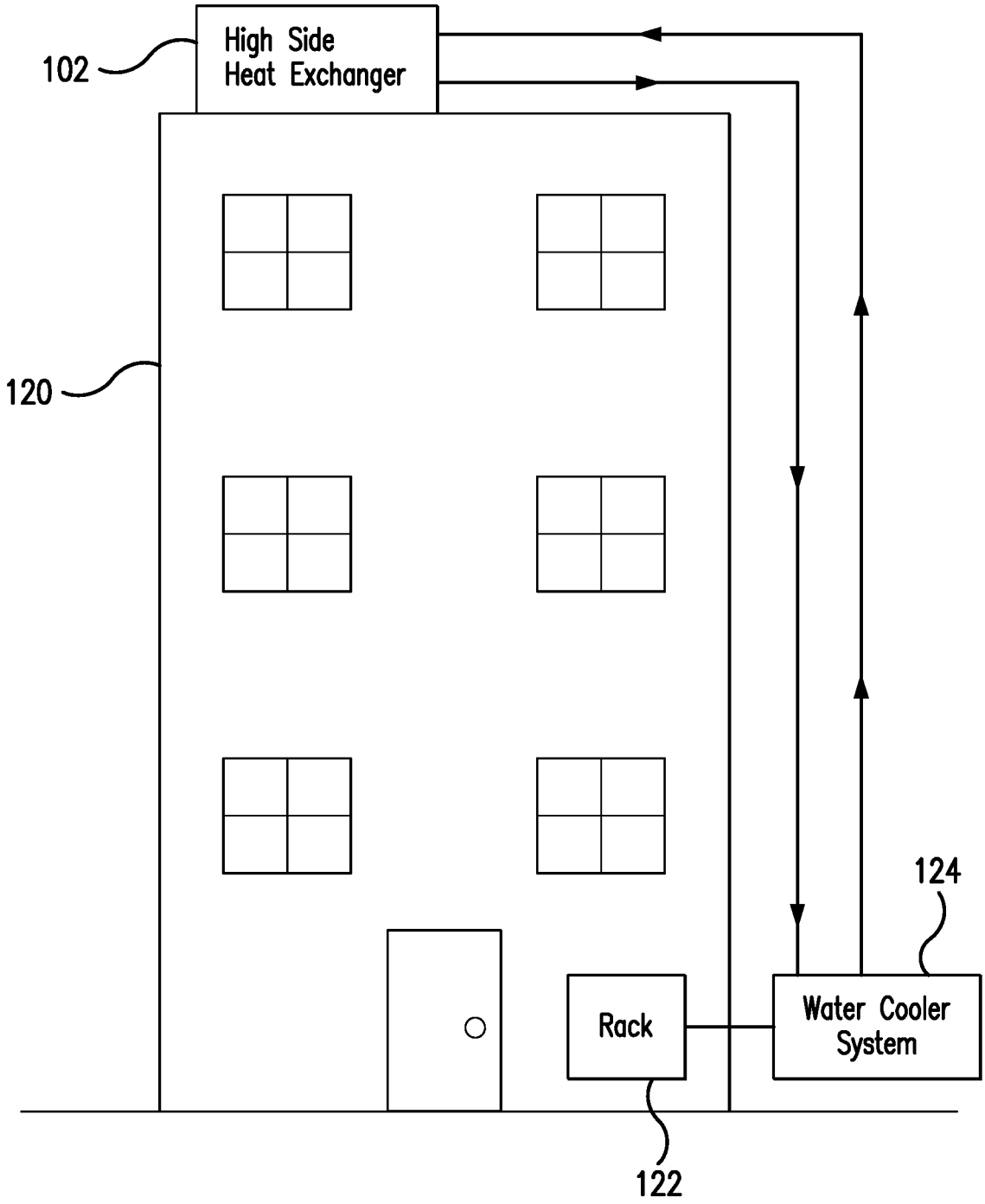

This disclosure contemplates an unconventional cooling system that uses P-traps to address the oil return issues that result from a vertical separation between the compressor and the high side heat exchanger. Generally, the vertical piping that carries the refrigerant from the compressor to the high side heat exchanger includes P-traps installed at various heights to capture oil in the refrigerant and to prevent that oil from flowing back to the compressor. T-connections are coupled to the P-traps to allow the oil to drain out of the P-traps. The oil may then be collected and returned to the compressor. In this manner, the P-traps prevent oil from flowing back to the compressor when there is a vertical separation between the compressor and the high side heat exchanger. Additionally, the cooling system reduces energy consumption, size, and cost relative to a cooling system that uses a separate water cooling system to overcome the vertical separation between the compressor and the high side heat exchanger. The cooling system will be described using FIGS. 1A through 3. FIGS. 1A-1B will describe an existing cooling system. FIGS. 2A-2C and 3 describe the cooling system that uses P-traps.

FIG. 1A illustrates an example cooling system 100. As shown in FIG. 1A, system 100 includes a high side heat exchanger 102, a flash tank 104, a low temperature low side heat exchanger 106, a medium temperature low side heat exchanger 108, a low temperature compressor 110, a medium temperature compressor 112, a valve 114, and an oil separator 116. Generally, system 100 cycles a refrigerant to cool spaces proximate the low side heat exchangers 106 and 108. Cooling system 100 or any cooling system described herein may include any number of low side heat exchangers, whether low temperature or medium temperature.

High side heat exchanger 102 removes heat from a refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchanger 106 and medium temperature low side heat exchanger 108.

When the refrigerant reaches low temperature low side heat exchanger 106 or medium temperature low side heat exchanger 108, the refrigerant removes heat from the air around low temperature low side heat exchanger 106 or medium temperature low side heat exchanger 108. For example, the refrigerant cools metallic components (e.g., metallic coils, plates, and/or tubes) of low temperature low side heat exchanger 106 and medium temperature low side heat exchanger 108 as the refrigerant passes through low temperature low side heat exchanger 106 and medium temperature low side heat exchanger 108. These metallic components may then cool the air around them. The cooled air may then be circulated such as, for example, by a fan to cool a space such as, for example, a freezer and/or a refrigerated shelf. As refrigerant passes through low temperature low side heat exchanger 106 and medium temperature low side heat exchanger 108, the refrigerant may change from a liquid state to a gaseous state as it absorbs heat. Any number of low temperature low side heat exchangers 106 and medium temperature low side heat exchangers 108 may be included in any of the disclosed cooling systems.

Refrigerant flows from low temperature low side heat exchanger 106 and medium temperature low side heat exchanger 108 to compressors 110 and 112. The disclosed cooling systems may include any number of low temperature compressors 110 and medium temperature compressors 112. Both the low temperature compressor 110 and medium temperature compressor 112 compress refrigerant to increase the pressure of the refrigerant. As a result, the heat in the refrigerant may become concentrated and the refrigerant may become a high-pressure gas. Low temperature compressor 110 compresses refrigerant from low temperature low side heat exchanger 106 and sends the compressed refrigerant to medium temperature compressor 112. Medium temperature compressor 112 compresses a mixture of the refrigerant from low temperature compressor 110 and medium temperature low side heat exchanger 108. When the compressors 110 and 112 compress the refrigerant, oil that coats certain components of compressors 110 and 112 may mix with and be discharged with the refrigerant.

Valve 114 controls a flow of flash gas from flash tank 104. When valve 114 is closed, flash tank 104 may not discharge flash gas through valve 114. When valve 114 is opened, flash tank 104 may discharge flash gas through valve 114. In this manner, valve 114 may also control an internal pressure of flash tank 104. Valve 114 directs flash gas to medium temperature compressor 112. Medium temperature compressor 112 compresses the flash gas along with refrigerant from low temperature compressor 110 and medium temperature low side heat exchanger 108.

FIG. 1B illustrates example cooling system 100 installed in a tall building 120. As seen in FIG. 1B, high side heat exchanger 102 is positioned on the roof of the building 120. Rack 122, which includes the other components of system 100 such as compressors 110 and 112, is positioned on a lower level of building 120. Thus, a significant vertical separation exists between high side heat exchanger 102 and compressors 110 and 112. If refrigerant from compressors 110 and/or 112 were directed to high side heat exchanger 102, the oil that mixed with the refrigerant discharged by the compressors 110 and/or 112 may not be able to overcome the vertical separation and, as a result, the oil may flow backwards to the compressor 112. To avoid this oil return issue, a separate water cooling system 124 is installed so that the refrigerant need not be directed to high side heat exchanger 102. Water cooling system 124 cycles water that absorbs heat from the refrigerant discharged by compressor 112. The water is then pumped to high side heat exchanger 102 on the roof so that the absorbed heat can be removed. The water is then cycled back down from high side heat exchanger 102 to absorb more heat from the refrigerant. The cooled refrigerant is cycled back to the rest of the cooling system, bypassing the high side heat exchanger 102. Water cooling system 124, however, increases the overall energy consumption, size, and cost of the cooling system.

This disclosure contemplates an unconventional cooling system that uses P-traps to address the oil return issues that result from a vertical separation between compressor 112 and high side heat exchanger 102. Generally, the vertical piping that carries the refrigerant from compressor 112 to high side heat exchanger 102 includes P-traps installed at various heights to capture oil in the refrigerant and to prevent that oil from flowing back to compressor 112. T-connections are coupled to the P-traps to allow the oil to drain out of the P-traps. The oil may then be collected and returned to compressors 110 and/or 112. In this manner, the P-traps prevent oil from flowing back to compressor 112 when there is a vertical separation between compressor 112 and high side heat exchanger 102. Additionally, the cooling system reduces energy consumption, size, and cost relative to a cooling system that uses water cooling system 124 to overcome the vertical separation between compressor 112 and high side heat exchanger 102. Embodiments of the cooling system are described below using FIGS. 2A-2C and 3. These figures illustrate embodiments that include a certain number of low side heat exchangers and compressors for clarity and readability. These embodiments may include any suitable number of low side heat exchangers and compressors.

Figure 2A:
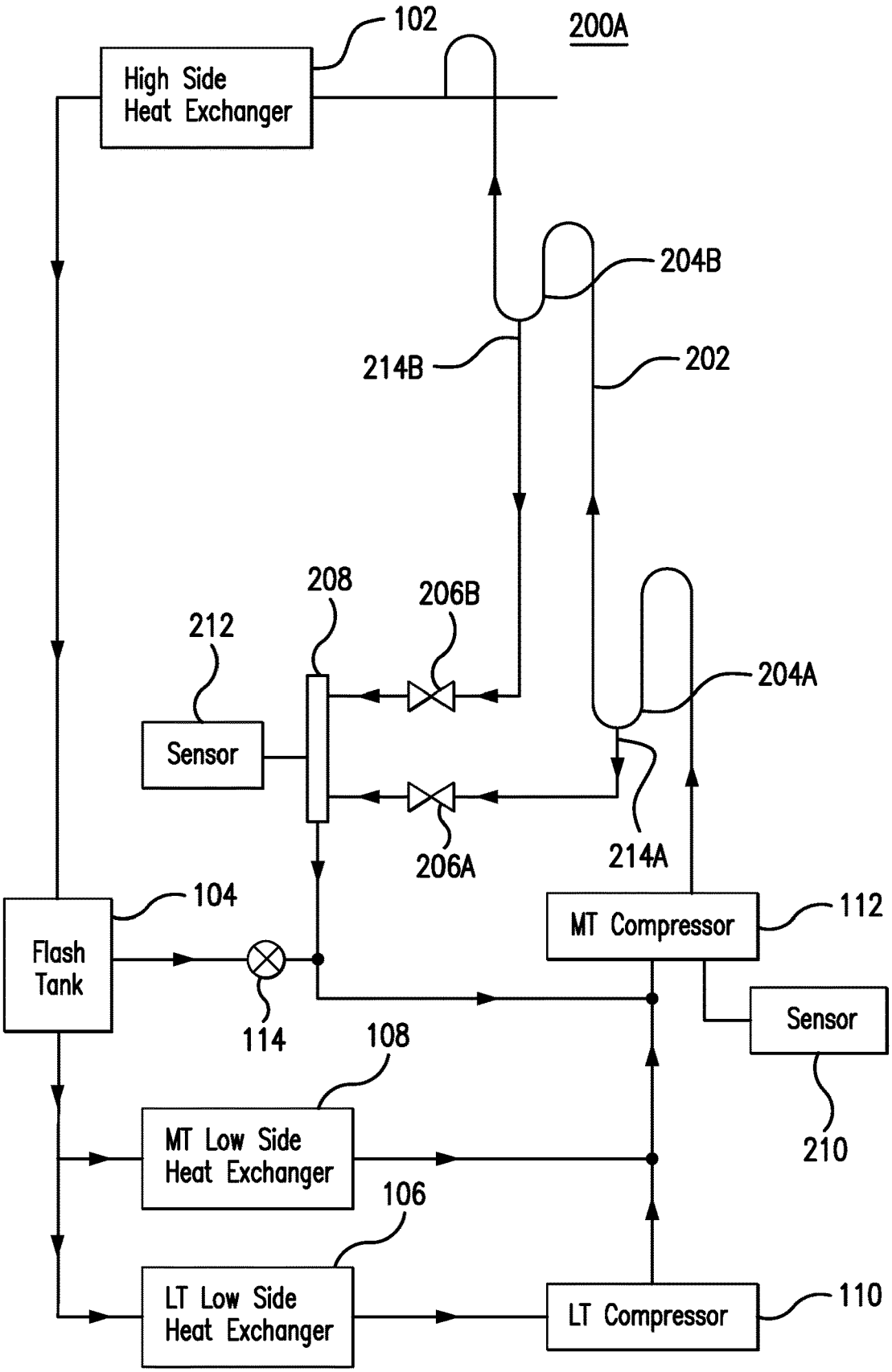
FIGS. 2A-2C illustrate example cooling systems.
Figure 2B:
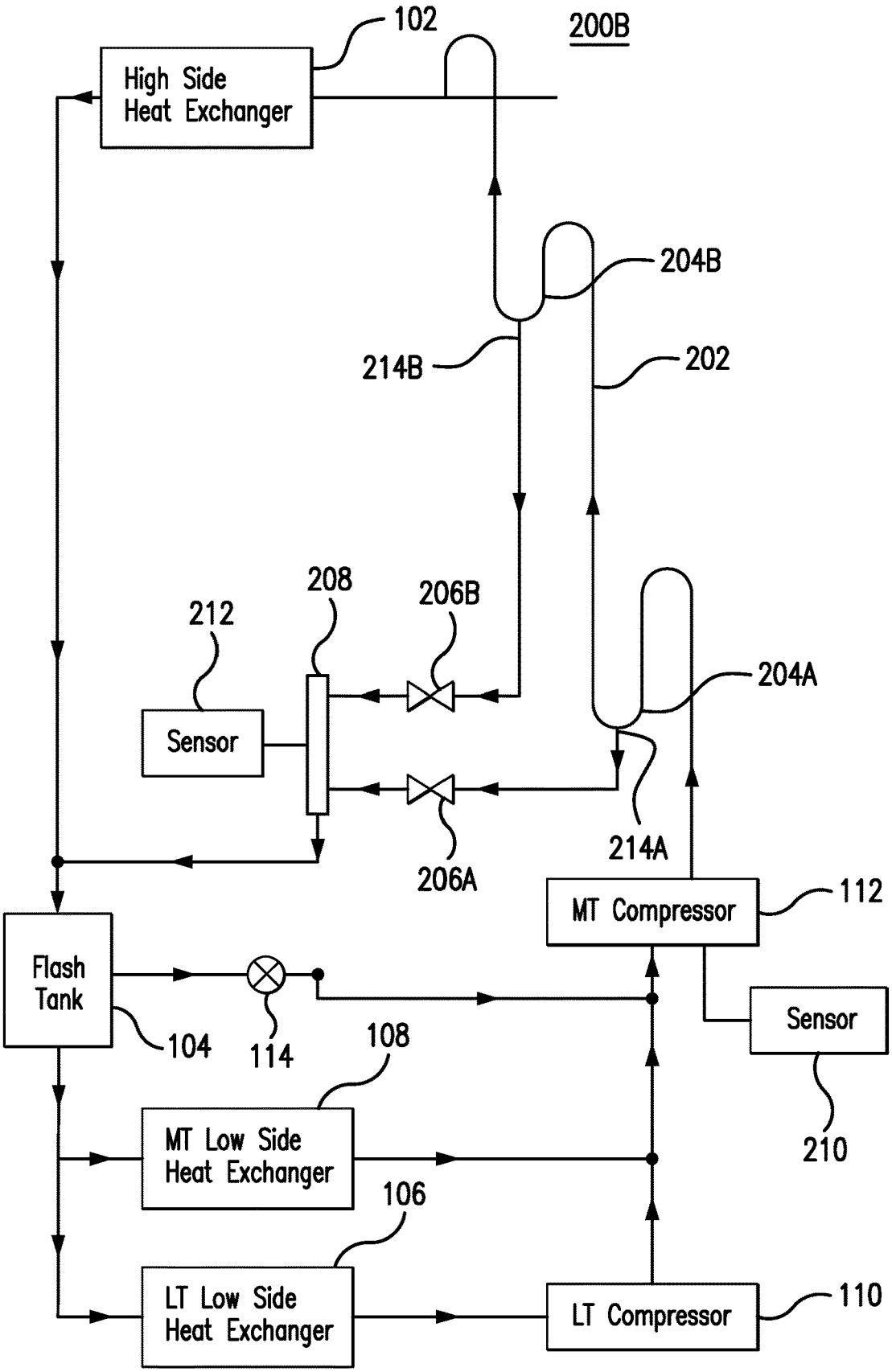
Figure 2C:
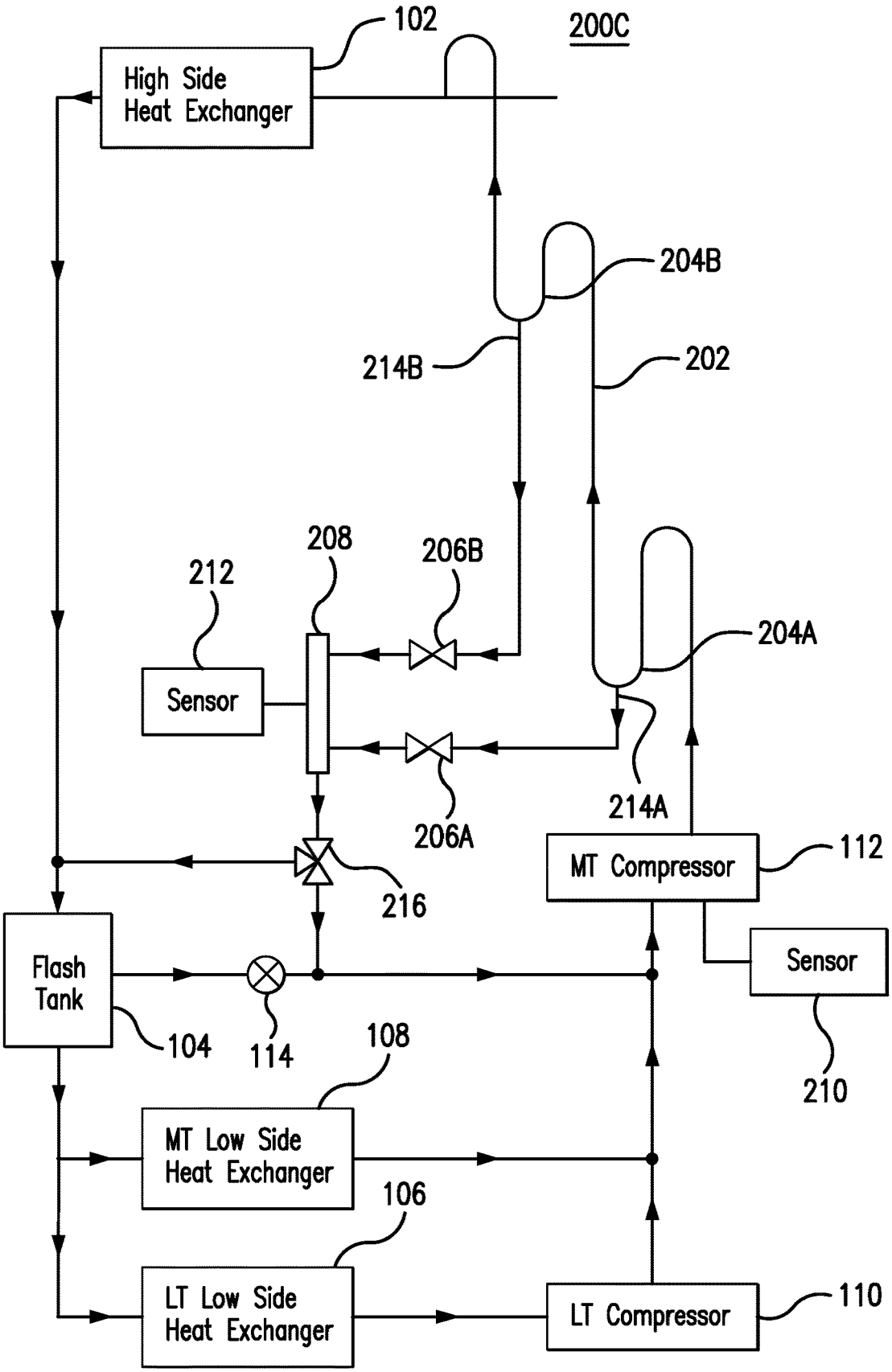

FIGS. 2A-2C illustrate example cooling systems 200. Generally, cooling system 200 includes P-traps installed in the vertical piping used to direct refrigerant from compressor 112 to high side heat exchanger 102. The P-traps collect oil and prevent that oil from flowing back to compressor 112. The systems in FIGS. 2A-2C may return that oil to different parts of system 200. For example, system 200 in FIG. 2A returns the oil to compressor 112. System 200 in FIG. 2B returns the oil to flash tank 104. System 200 in FIG. 2C returns the oil to compressor 112 and/or flash tank 104.

FIG. 2A illustrates an example cooling system 200A. As seen in FIG. 2A, system 200A includes a high side heat exchanger 102, a flash tank 104, a low temperature low side heat exchanger 106, a medium temperature low side heat exchanger 108, a low temperature compressor 110, a medium temperature compressor 112, valve 114, piping 202, valves 206A and 206B, a receiver 208, and sensors 210 and 212. There may be a significant vertical separation between high side heat exchanger 102 and medium temperature compressor 112. For example, high side heat exchanger 102 may be installed on the roof of a building such that high side heat exchanger 102 is 20 to 50 feet higher than medium temperature compressor 112. To overcome the issues associated with directing refrigerant up this vertical separation (e.g., oil flowing back to compressor 112), system 200A uses piping 202 that includes P-traps to collect oil and to prevent that oil from flowing back to medium temperature compressor 112. The oil may then be sent back to medium temperature compressor 112. As a result, system 200A does not need to use a separate water cooling system, which reduces energy consumption, size, and cost in certain embodiments.

Several components of system 200A operate similarly as they did in system 100. For example, high side heat exchanger 102 removes heat from a refrigerant. Flash tank 104 stores the refrigerant. Low temperature low side heat exchanger 106 and medium temperature low side heat exchanger 108 use refrigerant to cool spaces proximate low temperature low side heat exchanger 106 and medium temperature low side heat exchanger 108. Low temperature compressor 110 compresses refrigerant from low temperature low side heat exchanger 106. Medium temperature compressor 112 compresses refrigerant from low temperature compressor 110, medium temperature low side heat exchanger 108, and flash tank 104. Valve 114 controls the flow of refrigerant, as a flash gas, from flash tank 104 to medium temperature compressor 112.

Piping 202 directs refrigerant from medium temperature compressor 112 to high side heat exchanger 102. The structure of piping 202 allows piping 202 to carry refrigerant up the vertical separation to high side heat exchanger 102 without allowing oil to flow back to medium temperature compressor 112. As seen in FIG. 2A, piping 202 includes P-traps 204 installed at various heights on piping 202. P-trap 204A is installed at a lower height than P-trap 204B. Refrigerant flowing from medium temperature compressor 112 to high side heat exchanger 102 flows through P-trap 204A and then P-trap 204B enroute to high side heat exchanger 102. As the refrigerant, which is a vapor, flows through piping 202, oil in the refrigerant may begin to flow back towards medium temperature compressor 112. P-traps 204A and 204B collect the oil before the oil reaches medium temperature compressor 112. As a result, P-traps 204A and 204B prevent oil from flowing back to medium temperature compressor 112. As more refrigerant is sent through piping 202, more oil collects in P-traps 204A and 204B.

To prevent P-traps 204A and 204B from overflowing, T-connections 214A and 214B are installed in system 200A. T-connection 214A is coupled to P-trap 204A. T-connection 214B is coupled to P-trap 204B. T-connections 214A and 214B allow oil to drain out from P-traps 204A and 204B so that P-traps 204A and 204B do not overflow.

Valves 206A and 206B control a flow of oil and/or refrigerant from P-traps 204A and 204B to receiver 208. Valve 206A controls a flow of oil and refrigerant from P-trap 204A to receiver 208. Valve 206B controls a flow of oil and/or refrigerant from P-trap 204B to receiver 208. Valves 206A and 206B may be any suitable valve to control a flow of oil and/or refrigerant. In certain embodiments, valves 206A and 206B are pressure reducing solenoid valves. When valves 206A and 206B are open, oil and/or refrigerant from P-traps 204A and 204B may flow through valves 206A and 206B. When valves 206A and 206B are closed, oil and/or refrigerant collects in P-traps 204A and 204B and do not flow through valves 206A and 206B. The degree to which valves 206A and 206B are opened controls the amount of oil and/or refrigerant that flows through valves 206A and 206B per unit time. Oil and/or refrigerant that flows through valves 206A and 206B flows to receiver 208.

In certain embodiments, valves 206A and 206B may also serve as hot gas dump valves in system 200A. In other words, valves 206A and 206B may be opened to allow hot refrigerant from piping 202 to flow through valves 206A and 206B into receiver 208 and back to medium temperature compressor 112. For example, sensor 210 may include a temperature sensor that detects a temperature of the refrigerant received at medium temperature compressor 112. When the temperature of that refrigerant falls below a threshold, valves 206A and 206B may be opened to direct hot refrigerant through receiver 208 to medium temperature compressor 112 to raise the temperature of the refrigerant received at medium temperature compressor 112.

Receiver 208 collects oil and/or refrigerant from valves 206A and 206B. Receiver 208 may be a tank or container that holds fluids such as oil and/or refrigerant. In certain instances, receiver 208 may release oil and/or refrigerant to other sections of system 200A. Receiver 208 may release oil and/or refrigerant to medium temperature compressor 112.

As discussed above, valves 206A and 206B may be controlled to adjust the flow of oil and/or refrigerant to receiver 208. In certain embodiments, sensor 210 includes a pressure sensor that detects a discharge pressure of medium temperature compressor 112. When that discharge pressure falls below a threshold, it may indicate that too much oil is collecting in P-traps 204A and 204B. As a result, valves 206A and 206B may open to drain oil from P-traps 204A and 204B. In particular embodiments, valves 206A and 206B may open periodically. For example, valves 206A and 206B may open once per day to drain the oil collected in P-traps 204A and 204B. As another example, valves 206A and 206B may open once every few hours to drain the oil collected in P-traps 204A and 204B. In some embodiments, sensor 212 is a level sensor that detects a level of oil collected in receiver 208. When that level of oil falls below a threshold, it may mean that too much oil is collecting in P-traps 204A and 204B and/or that receiver 208 is available to receive any collected oil. As a result, valves 206A and 206B may be opened to drain the oil collected in P-traps 204A and 204B and to collect that oil in receiver 208. In this manner, refrigerant may flow through piping 202 to traverse the vertical separation between high side heat exchanger 102 and medium temperature compressor 112 without having oil flow back to medium temperature compressor 112.

Additionally, although sensor 210 has been described as a pressure sensor and a temperature sensor, sensor 210 may be one or both a pressure sensor and a temperature sensor. For example, sensor 210 may include one or more sensors, one of which is a temperature sensor and another which is a pressure sensor. The temperature sensor and the pressure sensor can be integrated or separate. Furthermore, sensor 210 may be either a pressure sensor or a temperature sensor.

FIG. 2B illustrates an example cooling system 200B. Generally, in system 200B, receiver 208 directs oil and/or refrigerant to flash tank 104 rather than medium temperature compressor 112, as in system 200A. In this manner, the oil and/or refrigerant may be supplied to components of system 200B other than medium temperature compressor 112.

Several components of system 200B operate similarly as they did in system 200A. High side heat exchanger 102 removes heat from a refrigerant. Flash tank 104 stores the refrigerant. Low temperature low side heat exchangers 106 and medium temperature low side heat exchanger 108 use refrigerant to cool spaces proximate low temperature low side heat exchanger 106 and medium temperature low side heat exchanger 108. Low temperature compressor 110 compresses refrigerant from low temperature low side heat exchanger 106. Medium temperature compressor 112 compresses refrigerant from low temperature compressor 110, medium temperature low side heat exchanger 108, and flash tank 104. Valve 114 controls the flow of refrigerant, as a flash gas, from flash tank 104 to medium temperature compressor 112. Piping 202 directs refrigerant from medium temperature compressor 112 to high side heat exchanger 102. P-traps 204A and 204B collect oil and prevent that oil from flowing back to medium temperature compressor 112. T-connections 214A and 214B allow oil to drain from P-traps 204A and 204B. Valves 206A and 206B control a flow of oil and/or refrigerant from P-traps 204A and 204B to receiver 208. Sensor 210 may be a pressure sensor that detects a discharge pressure of medium temperature compressor 112 and/or a temperature sensor that detects a temperature of the refrigerant received at medium temperature compressor 112. Sensor 212 may be a level sensor that detects a level of oil collected in receiver 208.

As discussed above, receiver 208 in system 200B directs oil and/or refrigerant to flash tank 104 rather than to medium temperature compressor 112, as in system 200A. By directing oil and/or refrigerant to flash tank 104, receiver 208 may direct oil and/or refrigerant to other components of system 200B in addition to medium temperature compressor 112.

FIG. 2C illustrates an example cooling system 200C. Generally, system 200C uses a valve 216 to direct oil and/or refrigerant to medium temperature compressor 112 and/or flash tank 104. In this manner, the flow of oil and/or refrigerant from receiver 208 may be controlled.

Several components of system 200C operate similarly as they did in systems 200A and 200B. High side heat exchanger 102 removes heat from a refrigerant. Flash tank 104 stores the refrigerant. Low temperature low side heat exchangers 106 and medium temperature low side heat exchanger 108 use refrigerant to cool spaces proximate low temperature low side heat exchanger 106 and medium temperature low side heat exchanger 108. Low temperature compressor 110 compresses refrigerant from low temperature low side heat exchanger 106. Medium temperature compressor 112 compresses refrigerant from low temperature compressor 110, medium temperature low side heat exchanger 108, and flash tank 104. Valve 114 controls the flow of refrigerant, as a flash gas, from flash tank 104 to medium temperature compressor 112. Piping 202 directs refrigerant from medium temperature compressor 112 to high side heat exchanger 102. P-traps 204A and 204B collect oil and prevent that oil from flowing back to medium temperature compressor 112. T-connections 214A and 214B allow oil to drain from P-traps 204A and 204B. Valves 206A and 206B control a flow of oil and/or refrigerant from P-traps 204A and 204B to receiver 208.

Sensor 210 may be a pressure sensor that detects a discharge pressure of medium temperature compressor 112 and/or a temperature sensor that detects a temperature of the refrigerant received at medium temperature compressor 112. Sensor 212 may be a level sensor that detects a level of oil collected in receiver 208. System 200C includes valve 216 that controls the flow of oil and/or refrigerant from receiver 208. Valve 216 may be a three-way valve. Valve 216 may be controlled to direct oil and/or refrigerant from receiver 208 to medium temperature compressor 112 and/or flash tank 104. For example, valve 216 may be adjusted to direct all oil and/or refrigerant to medium temperature compressor 112. In another example, valve 216 may be adjusted to direct all oil and/or refrigerant to flash tank 104. And in yet another example, valve 216 may be adjusted to direct some oil and/or refrigerant to medium temperature compressor 112 and some oil and/or refrigerant to flash tank 104. In this manner, the flow of oil and/or refrigerant from receiver 208 may be controlled.

Figure 3:
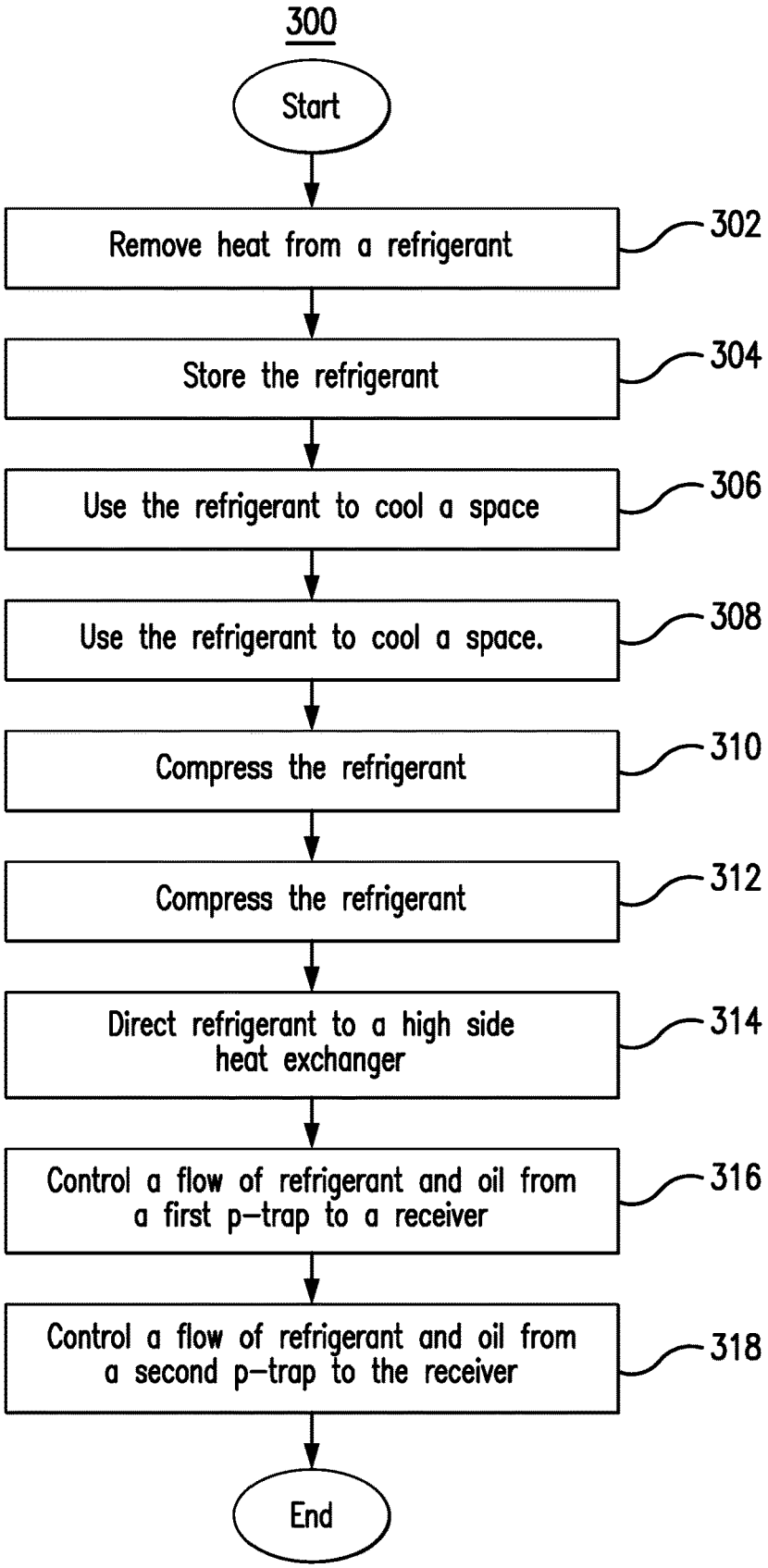
FIG. 3 is a flowchart illustrating a method of operating an example cooling system.

FIG. 3 is a flow chart illustrating a method 300 of operating an example cooling system 200. Generally, various components of systems 200A, 200B, and 200C perform the steps of method 300. In particular embodiments, performing method 300 reduces the energy consumption, size, and cost of cooling systems 200A, 200B, and 200C relative to cooling systems that use a water cooling system.

In step 302, high side heat exchanger 102 removes heat from a refrigerant. Flash tank 104 stores the refrigerant in step 304. In step 306, low temperature low side heat exchanger 106 uses the refrigerant to cool a space. In step 308, medium temperature low side heat exchanger 108 uses the refrigerant to cool a space. Low temperature compressor 110 compresses the refrigerant from low temperature low side heat exchanger 106 in step 310. In step 312, medium temperature compressor 112 compresses the refrigerant from low temperature compressor 110, medium temperature low side heat exchanger 108, and flash tank 104.

In step 314, piping 202 directs refrigerant from medium temperature compressor 112 to high side heat exchanger 102. There may be a significant vertical separation of twenty to fifty feet between high side heat exchanger 102 and medium temperature compressor 112. Piping 202 may include P-traps 204A and 204B that collect oil such that the oil mixed with the refrigerant in piping 202 does not flow backwards or downwards to medium temperature compressor 112 as the refrigerant flows upwards in piping 202. In this manner, refrigerant can traverse the vertical separation between high side heat exchanger 102 and medium temperature compressor 112 without having oil flow back to medium temperature compressor 112. In step 316, valve 206A controls a flow of refrigerant and oil from P-trap 204A to receiver 208. In step 318, valve 206B controls a flow of refrigerant and oil from P-trap 204B to receiver 208. In this manner, valves 206A and 206B allow oil collected in P-traps 204A and 204B to drain to receiver 208.

Modifications, additions, or omissions may be made to method 300 depicted in FIG. 3. Method 300 may include more, fewer, or other steps. For example, steps may be performed in parallel or in any suitable order. While discussed as systems 200A-200C (or components thereof) performing the steps, any suitable component of systems 200A-200C may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the low temperature low side heat exchanger) even though there may be other intervening components between the particular component and the destination of the refrigerant. For example, the medium temperature compressor receives a refrigerant from the low temperature low side heat exchanger even though there is a low temperature compressor between the low temperature low side heat exchanger and the medium temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a heat exchanger configured to remove heat from a refrigerant;

a flash tank configured to store the refrigerant;

a compressor configured to compress refrigerant, the heat exchanger positioned vertically above the compressor;

piping configured to direct refrigerant from the compressor to the heat exchanger, the piping comprising:

a first P-trap positioned vertically above the compressor and vertically below the heat exchanger; and a second P-trap positioned vertically above the first P-trap and vertically below the heat exchanger;

a receiver;

a first valve configured to control a flow of refrigerant and oil from the first P-trap to the receiver; and a second valve configured to control a flow of refrigerant and oil from the second P-trap to the receiver.

2. The system of claim 1, the receiver configured to direct refrigerant to the compressor.

3. The system of claim 1, further comprising a sensor configured to detect a temperature of refrigerant received at the compressor, the first valve opens when the temperature falls below a threshold.

4. The system of claim 1, further comprising a sensor configured to detect a discharge pressure of the compressor, the first and second valves open when the discharge pressure falls below a threshold.

5. The system of claim 1, the first and second valves configured to open once per day.

6. The system of claim 1, further comprising a sensor configured to detect a level of oil in the receiver, the first and second valves open when the level falls below a threshold.

7. The system of claim 1, the receiver configured to direct refrigerant to the flash tank.

8. A method comprising:

removing, by a heat exchanger, heat from a refrigerant;

storing, by a flash tank, the refrigerant;

compressing, by a compressor, refrigerant, the heat exchanger positioned vertically above the compressor;

directing, by piping, refrigerant from the compressor to the heat exchanger, the piping comprising:

a first P-trap positioned vertically above the second compressor and vertically below the heat exchanger; and a second P-trap positioned vertically above the first P-trap and vertically below the heat exchanger;

controlling, by a first valve, a flow of refrigerant and oil from the first P-trap to a receiver; and controlling, by a second valve, a flow of refrigerant and oil from the second P-trap to the receiver.

9. The method of claim 8, further comprising directing, by the receiver, refrigerant to the compressor.

10. The method of claim 8, further comprising:

detecting, by a sensor, a temperature of refrigerant received at the compressor; and opening the first valve when the temperature falls below a threshold.

11. The method of claim 8, further comprising:

detecting, by a sensor, a discharge pressure of the compressor; and opening the first and second valves when the discharge pressure falls below a threshold.

12. The method of claim 8, further comprising opening the first and second valves once per day.

13. The method of claim 8, further comprising:

detecting, by a sensor, a level of oil in the receiver; and opening the first and second valves when the level falls below a threshold.

14. The method of claim 8, further comprising directing, by the receiver, refrigerant to the flash tank.

15. A system comprising:

a compressor configured to compress refrigerant;

a heat exchanger configured to remove heat from the refrigerant from the compressor, the heat exchanger positioned vertically above the compressor;

piping configured to direct refrigerant from the compressor to the heat exchanger, the piping comprising:

a first P-trap positioned vertically above the compressor and vertically below the heat exchanger; and a second P-trap positioned vertically above the first P-trap and vertically below the heat exchanger;

a receiver;

a first valve configured to control a flow of refrigerant and oil from the first P-trap to the receiver; and a second valve configured to control a flow of refrigerant and oil from the second P-trap to the receiver.

16. The system of claim 15, the receiver configured to direct refrigerant to the compressor.

17. The system of claim 15, further comprising a sensor configured to detect a temperature of refrigerant received at the compressor, the first valve opens when the temperature falls below a threshold.

18. The system of claim 15, further comprising a sensor configured to detect a discharge pressure of the compressor, the first and second valves open when the discharge pressure falls below a threshold.

19. The system of claim 15, the first and second valves configured to open once per day.

20. The system of claim 15, further comprising a sensor configured to detect a level of oil in the receiver, the first and second valves open when the level falls below a threshold.

* * * * *